US007645173B2

(12) United States Patent
Larkin

(10) Patent No.: US 7,645,173 B2
(45) Date of Patent: Jan. 12, 2010

(54) ADJUSTABLE CABLE CONNECTOR WIRE GUIDE AND CONNECTOR ASSEMBLY INCORPORATING THE SAME

(75) Inventor: Brian S. Larkin, Moss Beach, CA (US)

(73) Assignee: Tyco Thermal Controls LLC, Menlo Park, CA (US)

( * ) Notice: Subject to any disclaimer, the term of this patent is extended or adjusted under 35 U.S.C. 154(b) by 0 days.

(21) Appl. No.: 11/568,795

(22) PCT Filed: May 5, 2005

(86) PCT No.: PCT/US2005/015758

§ 371 (c)(1),
(2), (4) Date: Aug. 17, 2007

(87) PCT Pub. No.: WO2005/112198

PCT Pub. Date: Nov. 24, 2005

(65) Prior Publication Data

US 2008/0182449 A1 Jul. 31, 2008

Related U.S. Application Data

(60) Provisional application No. 60/569,474, filed on May 7, 2004.

(51) Int. Cl.
*H01R 4/44* (2006.01)

(52) U.S. Cl. ..... 439/781; 174/94 S

(58) Field of Classification Search ..... 439/781–784, 439/894, 449, 807, 284; 174/944, 94 S, 94 R
See application file for complete search history.

(56) References Cited

U.S. PATENT DOCUMENTS 2,092,372 A * 9/1937 Goeller ..... 439/781
2,835,852 A 5/1958 Crotty, Jr. et al.
3,189,863 A 6/1965 Leach
3,720,778 A 3/1973 Woertz et al
3,923,363 A 12/1975 Kraft
4,018,499 A 4/1977 Rickards
4,023,883 A 5/1977 Raposa et al.
4,126,759 A * 11/1978 Brooks ..... 174/94 R
4,707,051 A * 11/1987 Hall ..... 439/781
4,813,883 A 3/1989 Staley
4,857,020 A * 8/1989 Crosby ..... 439/783
4,861,278 A 8/1989 McBride et al.
5,059,137 A 10/1991 Dale et al.
5,378,171 A 1/1995 Czerlanis
5,842,893 A * 12/1998 De Keyser ..... 439/783
5,911,604 A * 6/1999 Chadbourne ..... 439/783
6,083,035 A 7/2000 Mackey et al.
6,120,334 A * 9/2000 Timsit et al. ..... 439/783
6,123,571 A 9/2000 Craft (Continued)

FOREIGN PATENT DOCUMENTS

GB 2203002 A1 10/1988

*Primary Examiner*—T C Patel
*Assistant Examiner*—Harshad C Patel
(74) *Attorney, Agent, or Firm*—Wyatt Pratt

(57) ABSTRACT

A cable connector wire guide and a connector assembly including the same. The wire guide includes first and second portions defining a cable opening. The first and second portions are configured to allow for expansion of the cable opening to allow cables of different dimensions to be received within the cable opening.

6 Claims, 6 Drawing Sheets

U.S. PATENT DOCUMENTS 6,152,786 A * 11/2000 Perrin et al. ..... 439/783
6,158,113 A 12/2000 Saito et al.
6,159,035 A 12/2000 Smith, III
6,206,720 B1 3/2001 Larkin et al.
6,206,734 B1 3/2001 Liu
6,305,967 B1 10/2001 Smith, III
6,322,402 B1 * 11/2001 Chadbourne et al. ..... 439/783
6,390,861 B1 * 5/2002 DeFrance ..... 439/783
6,494,737 B1 12/2002 Daoud et al.
6,558,184 B1 5/2003 Melocchi et al.
7,304,243 B2 * 12/2007 Polidori ..... 174/84 C
7,387,546 B2 * 6/2008 Copper et al. ..... 439/781
2002/0142674 A1 * 10/2002 Chadbourne et al. ..... 439/783
2004/0048522 A1 * 3/2004 Facey et al. ..... 439/783

* cited by examiner

ADJUSTABLE CABLE CONNECTOR WIRE GUIDE AND CONNECTOR ASSEMBLY INCORPORATING THE SAME

CROSS-REFERENCE TO RELATED APPLICATIONS

The present application claims the benefit of U.S. provisional patent application Ser. No. 60/569,474, filed on May 7, 2004, the teachings of which are incorporated herein by reference.

TECHNICAL FIELD

The present invention relates in general to an adjustable cable connector wire guide and a connector assembly incorporating the same.

BACKGROUND

Elongate cables such as power cords, grounded power leads, or heating cables often must be electrically connected to another elongate cable or to a source of electrical power such as a wall outlet. An electrical plug is frequently used to make connection to a power source. Connection of the cable to the connector or the plug can require tedious and craft-sensitive assembly, as well as the use of special tools, in order to ensure that good electrical connection is achieved.

Elongate heating cables are one type of cable which often requires connection to a connector or a plug. Such heating cables are known for use in the freeze protection and temperature maintenance of pipes. Particularly useful elongate heating cables include: first and second elongate electrodes; a plurality of resistive heating elements connected in parallel between the electrodes, e.g. a continuous strip of a conductive polymer in which the electrodes are embedded or which is wrapped around the electrodes; and an insulating jacket, composed, for example of an insulating polymer, which surrounds the electrodes and heating elements. In addition, the heating cable often also includes a metallic grounding layer, in the form of a braid or a tape, surrounding the insulating jacket, which serves to electrically ground the heating cable and provides abrasion resistance. The heating cable may be cut to the appropriate length for each application, and connection must then be made to the connector or plug.

Connectors and electrical plugs for use with electrical cables such as heating cables often require that, prior to installation of the cable into the plug, the conductive polymer be stripped from the electrodes. Stripping the polymer can be difficult, may require special tools, and may not result in completely "clean" electrodes, thus making good electrical connection to the plug difficult. In addition, the time required to strip the polymer and assemble the plug can be relatively significant.

To address these inefficiencies, insulation displacement connectors have been developed for use in making electrical contact to the electrodes of electrical cables. An insulation displacement connector (IDC) can be of any configuration, but often has a fork shape, with two tines separated by a slot and connected at a base. Often the tines have sharp edges at their tips to penetrate the polymer surrounding the electrodes. U.S. Pat. No. 6,206,720, the teachings of which are incorporated herein by reference, teaches an IDC including a beveled groove at the bottom of the slot between the tines. The beveled groove provides a notch in the polymer surrounding the electrodes, which separates the polymer and leaves a clean surface for good electrical connection.

It is often useful to mount IDCs onto a fixture to make electrical connection easier. A fixture for an IDC may include a wire guide module having a fixed channel size for receiving the electrical cable. When the cable is inserted into the channel and the IDC module and the wire guide module are mated, the cable is forced against the tines on the IDC so that the tines pierce the cable to make electrical contact with the cable electrodes. However, the fixed channel size of such a wire guide limits the guide to use with cables having a dimension corresponding to the fixed channel size. When cables of different dimensions are used, a different wire guide must be provided in a connector assembly. Storing and assembling different sized wire guides into connector assemblies to accommodate different sized cables can be inefficient.

Accordingly, there is a need for a wire guide for an IDC connector assembly that is configured to accommodate multiple cable sizes.

BRIEF DESCRIPTION OF THE DRAWINGS

Advantages of the present invention will be apparent from the following detailed description of exemplary embodiments thereof, which description should be considered in conjunction with the accompanying drawings, in which.

DETAILED DESCRIPTION

For ease of explanation, a wire guide consistent with the invention may be described herein in connection particular exemplary embodiments thereof. For example, a wire guide may be described herein as being useful in connection with making connections to heater cables. A wire guide consistent with the invention may, however, be used to make electrical connection to a wide variety of electrical cable types and configurations. For example, the electrical cable may comprise a heating cable, a power cable or cord, a grounded power lead, or other type of cable including at least one elongate electrode. Also the wire guide may be used either alone or in a connector assembly, e.g. as part of an electrical plug for making a connection to an electrical power source such as a wall outlet. It is to be understood, therefore, that illustrated exemplary embodiments described herein are provided only by way of illustration, and are not intended to be limiting.

The expressions "electrically connected" and "electrically coupled" as used herein refer to any connection, coupling, link or the like by which electrical current carried by one system element is conducted to the "communicating" or "coupled" element. Such "electrically connected" or "electrically coupled" devices are not necessarily directly connected to one another and may be separated by intermediate components or devices. Likewise, the terms "connected" or "coupled" as used herein in regard to physical connections or couplings is a relative term and does not require a direct physical connection.

Figure 1:
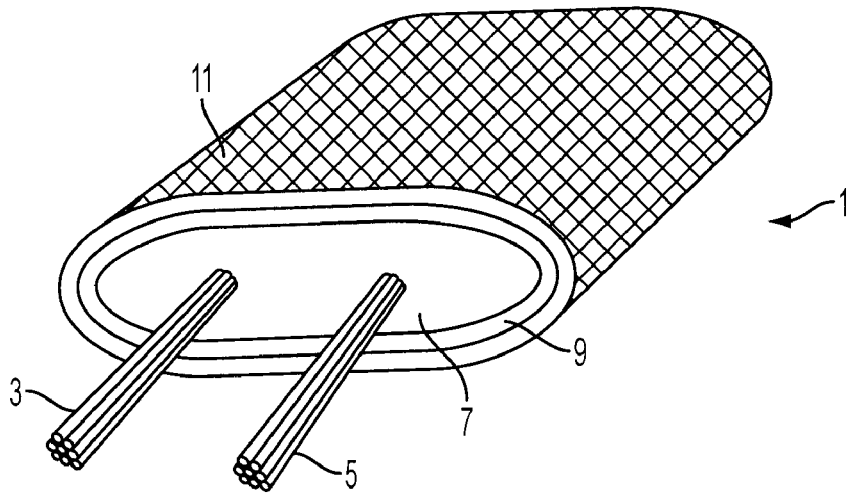
FIG. 1 is a perspective view of an electrical cable for use with an assembly or electrical plug consistent with the present invention.

FIG. 1 is a perspective view of an exemplary electrical cable 1, e.g. a heating cable, in which a first elongate electrode 3 and second elongate electrode 5 are embedded in conductive polymer matrix 7 which provides a resistive heating element. Insulating layer 9, which may include more than one layer, surrounds the conductive polymer matrix, and a metallic grounding layer 11 surrounds the insulating layer. The insulating layer 9 may be polymeric, e.g., in the form of a continuous polymer layer, a polymeric braid, or a polymer tape. The metallic grounding layer 11 may be in the form of a metallic braid serving to electrically ground the heating cable and to provide mechanical strength and abrasion resistance. In some applications, the grounding layer 11 may be surrounded by an insulating jacket to provide environmental and electrical insulation to the heating cable. Also, although the illustrated exemplary embodiment has an elliptical cross-section, the cable may have other geometries, e.g. round, oval, or rectangular.

Figure 2A:
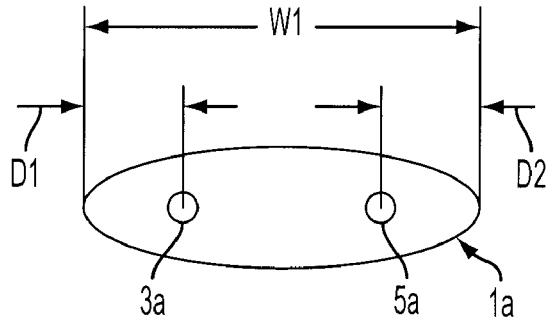
FIGS. 2A and 2B are schematic cross-sectional illustrations of first and second electrical cables having different widths.
Figure 2B:
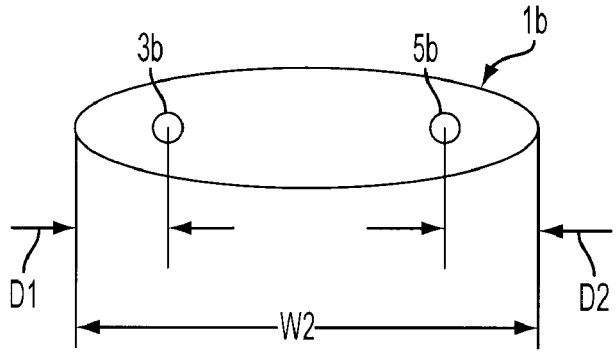

FIGS. 2A and 2B are schematic illustrations of the ends of two separate cables 1*a*, 1*b* having different overall widths. As shown, cable 1*a* has width W1, whereas cable 1*b* has a width W2, which is greater than W1. In cable 1*a*, shown in FIG. 2A, the linear distance from the center of the electrode 3*a* to the outer edge of the cable 1*a* is D1. The linear distance from the center of the electrode 5*a* to the opposed outer edge of the cable is D2. Within manufacturing tolerances, D1 may be equal to D2. Also, within manufacturing tolerances, the linear distance from the center of the electrode 3*b*, shown in FIG. 2B, to the outer edge of the cable 1*b* may be equal to D1, and the linear distance from the center of the electrode 5*b* to the opposed outer edge of the cable may be equal to D2. The uniform distance D1, D2 in cables of varying width, e.g., W1 and W2, allows a wire guide configuration consistent with the invention wherein the wire guide may expand/contract to receive a cable having a particular width while allowing electrical connection to the cable electrodes using an IDC connector.

Figure 3:
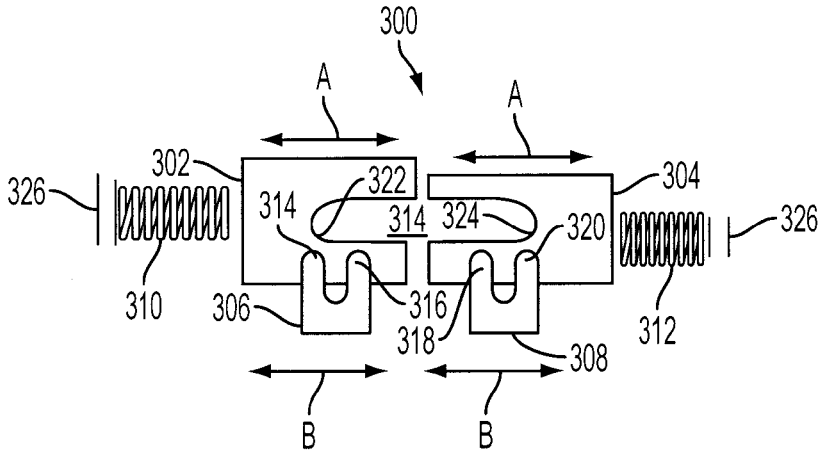
FIG. 3 is schematic illustration of an exemplary wire guide assembly consistent with the present invention.

FIG. 3 is a schematic illustration of an exemplary wire guide assembly 300 consistent with the present invention. As shown, the assembly includes first 302 and second 304 wire guide portions. The first wire guide portion 302 may be coupled, either directly or indirectly, to a first IDC fork 306 including first 314 and second 316 tines, and the second wire guide portion 304 may be coupled, either directly or indirectly, to a second IDC fork 308 including first 318 and second 320 tines. The IDC forks 306, 308 may be configured, for example, as described in U.S. Pat. No. 6,206,720.

The first and second wire guide portions may be disposed adjacent each other for defining a wire guide opening 314 therethrough. A surface 322 on the first wire guide may define a first portion of the wire guide opening and a surface 324 of the second wire guide may define a second portion of the opening. The wire guide IDC forks 306, 308 may be positioned relative to the first and second surfaces, respectively, so that when a cable is disposed against the first and second surfaces, the electrodes are positioned between the tines of the forks.

The first and second wire guide portions may be biased by springs 310, 312 against a fixed structure 326 to allow for independent movement of the wire guide portions 302, 304 with their associated forks in the directions of arrows, A, B. As a cable having a first width, e.g. W1, is inserted into the wire guide opening 314, the springs 310, 312 may be independently compressed to a first extent, and the opening 314 may be sized by the relative movement of the wire guide portions and forks to accommodate the cable width. When a cable having a larger width, e.g. W2, is inserted into the wire guide opening 314, the springs may be compressed to a greater extent, allowing for greater separation of the wire guide portions and their associated forks to size the opening 314 to accommodate the larger cable width. Since the forks move with their associated wire guide portions, the forks remain positioned for receiving the electrodes between their tines when the cable is forced against the tines.

A wire guide assembly consistent with the invention is thus configured for receiving cables having different dimensions, e.g. different widths. The expansion/contraction of the wire guide modules also facilitates connection to cables that are not centered relative to the cable opening. Although not shown, it is noted that the wire guides may be further segmented, e.g. into quadrants, to allow for expansion/contraction of the wire guide segments to accommodate cables having different widths and/or different heights. In such an embodiment, the forks may have a fixed relationship to one segment so that the electrodes are received between their tines when the cable is forced against the tines.

Figure 4:
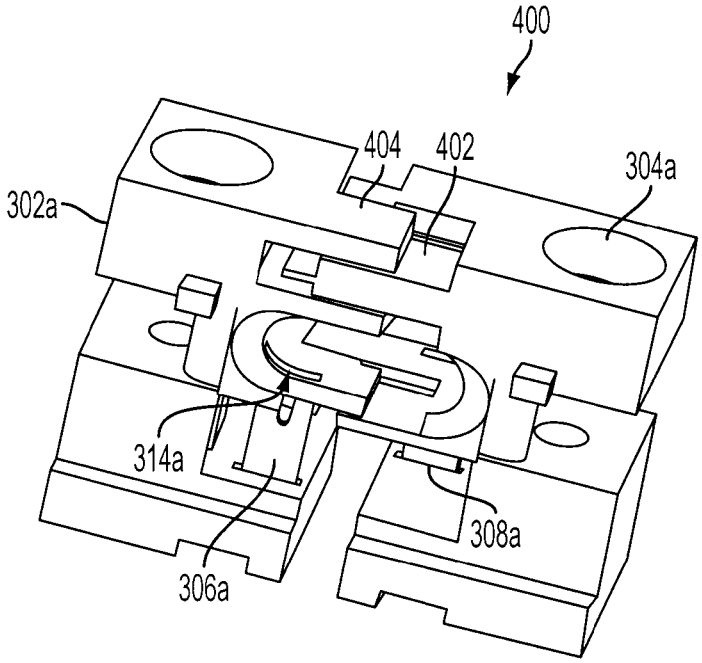
FIG. 4 is a perspective view of an exemplary wire guide assembly consistent with the present invention.
Figure 5:
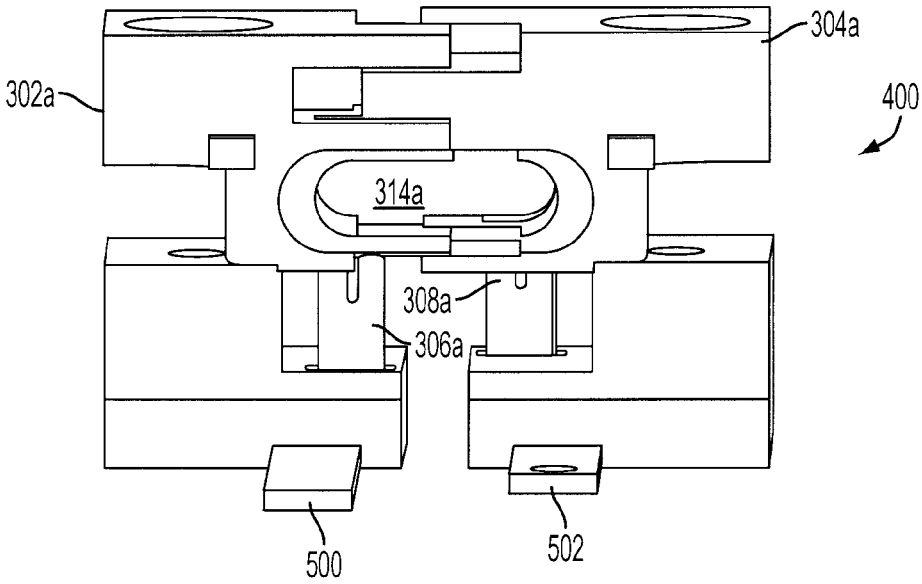
FIG. 5 is a front view of the assembly illustrated in FIG. 4.

FIGS. 4 and 5 illustrate one exemplary embodiment 400 of a wire guide consistent with the invention. In the illustrated exemplary embodiment, the wire guide portions 302*a*, 304*a* are configured with interlocking slots and projections, e.g. 402, 404, and the forks 306*a*, 308*a* are disposed in associated slots of the respective wire guide portions for movement therewith. As the wire guide portions are forced downward relative to the forks, a cable within the wire guide opening 314*a* is forced against the forks and portions of the forks 306*a*, 308*a* may extend through the slots with the cable electrodes coming into electrical contact with the forks. The forks may be electrically connected to associated electrodes 500, 502 for providing an electrical connection between the cable electrodes to be received between the tines of the forks and an electrical terminal.

Figure 6:
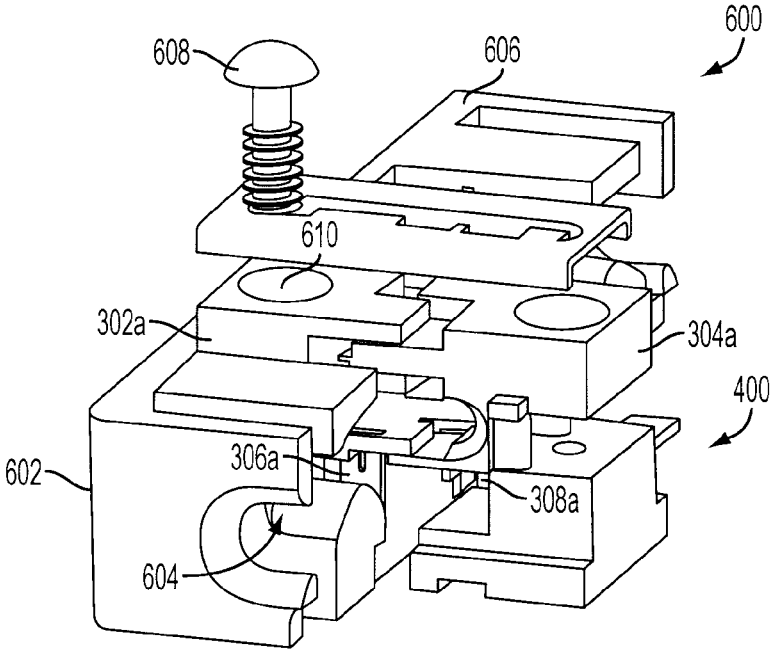
FIG. 6 is a perspective view of a connector assembly consistent with the present invention including the assembly illustrated in FIG. 4.

FIG. 6 is a perspective view of a wire guide assembly 400 consistent with the invention in a portion of connector assembly 600 shown in cross-section. The connector assembly may include a housing portion 602. The wire guide biasing springs, e.g. springs 310, 312, may be disposed between the housing portion 602 and the wire guide portions 302*a*, 304*a*. The housing portion may also include openings 604 for receiving the cable and directing the cable into the wire guide opening. The openings 604 in the housing may provide strain relief for the cable, either alone or in combination with a clip or latch (not shown).

The assembly may also include one or more plates 606 disposed over the wire guide portions. One or more fasteners, e.g. screws 608, may extend through the plate and associated openings 610 in the wire guide portions, and may be received in an associated portion of the housing, e.g. a threaded opening. The wire guide portions may be forced downward relative to the forks 306*a*, 308*a* by imparting force on the plate(s) 606 via the fastener. For example, a screw may be threaded into a threaded opening in the housing to force the plate 606 downward against the wire guide portions 302*a*, 304*a*, thereby forcing a cable in the wire guide opening against the forks 306*a*, 308*a*. The wire guides and the housing may be made of a transparent material, e.g. a polymer, so that during installation it is possible to observe the position of the cable.

Figure 7A:
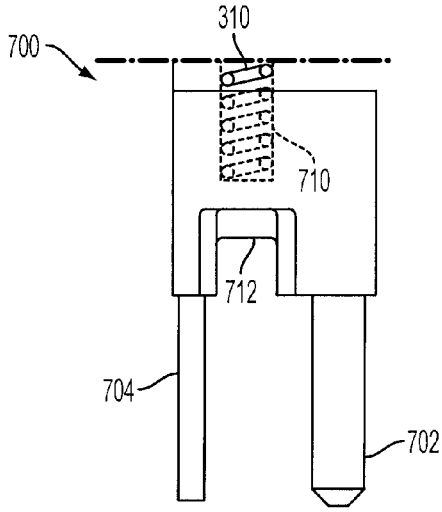
FIGS. 7A and 7B are end and side views, respectively, of an exemplary wire guide portion consistent with the present invention.
Figure 7B:
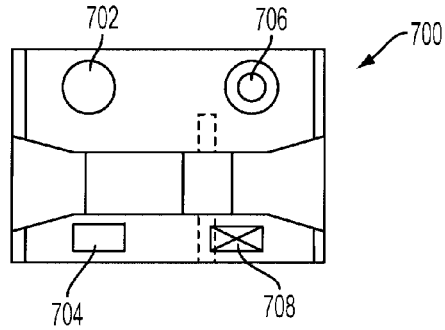
Figure 8:
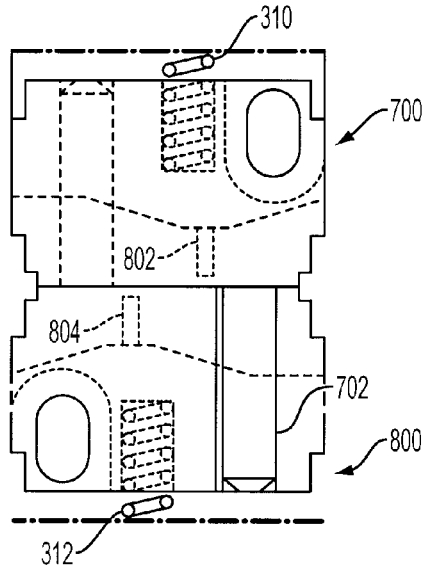
FIG. 8 is a top view, partially in phantom, of a wire guide assembly consistent with the present invention including first and second wire guide portions shown in FIG. 7.
Figure 9A:
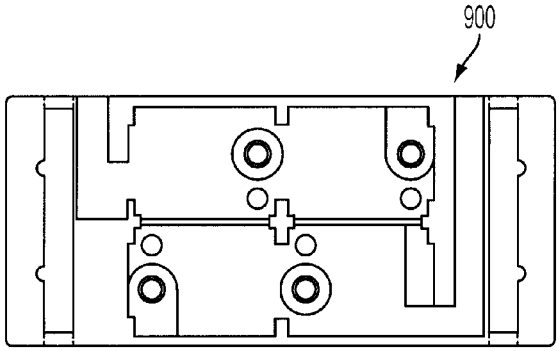
FIGS. 9A-9D are top, side, end and sectional views of a first housing portion useful in forming a connector assembly consistent with the present invention.
Figure 9C:
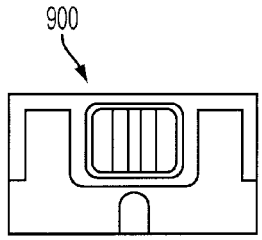
Figure 9B:
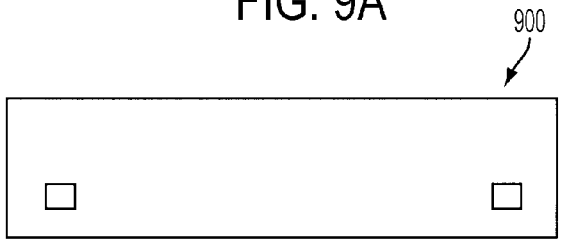
Figure 9D:
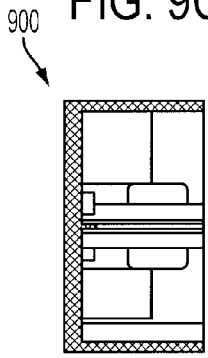
Figure 10A:
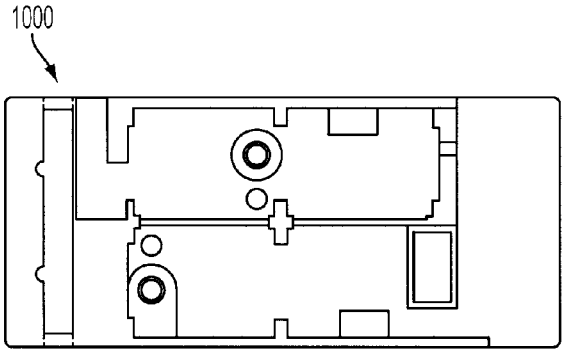
FIGS. 10A-C are top, side and end views of a second housing portion useful in forming a connector assembly consistent with the present invention.
Figure 10C:
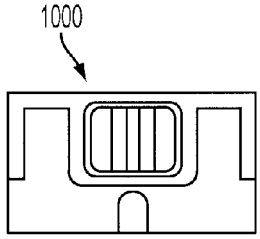
Figure 10B:
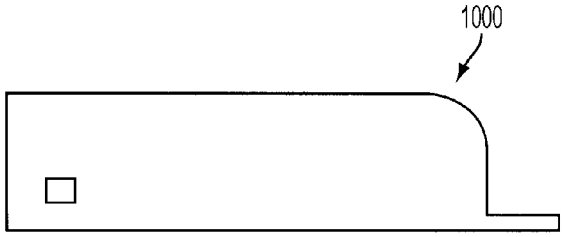

FIGS. 7A and 7B are side and end views, respectively, of another exemplary embodiment 700 of a wire guide consistent with the invention. The exemplary wire guide may include first 702 and second 704 projections for extending into associated openings in an opposed wire guide, and first 706 and second openings 708 for receiving first and second projections of an opposed mating wire guide 800, as shown for example, in FIG. 8. The wire guide 700 may include a bore 710 for receiving a compression spring 310 for biasing the wire guide against a housing. When first 700 and second 800 ones of the wire guides are mated, as shown in FIG. 8, surfaces of the wire guides, e.g. surface 712, define a cable opening. Slots 802, 804 in the wire guides receive the IDC forks. The cable opening may expand and contract against the bias of the springs 310, 312 to accommodate different sized cables.

While a wire guide assembly consistent with the invention may be used by itself, it may be used as part of an electrical plug. The plug housing may include first and second housing members which may be provided in an unmated or a mated configuration. In an unmated configuration, the housing members may be separate pieces or they may be connected, e.g. by hinges. When mated, the housing members may be in contact with each other, either directly or indirectly through a sealing member such as a gasket. The housing members may be maintained in their mated configuration by means of a securing means, e.g. a strap, a latch, a spring clamp, a bracket, one or more screws, integral snaps, etc. The securing means may be removable in order to allow the housing members to be unmated from one another and allow the plug to be re-enterable. In one embodiment, the securing means may include screws which, when tightened after insertion of the cable, ensure that good electrical contact is achieved and maintained.

Figure 11:
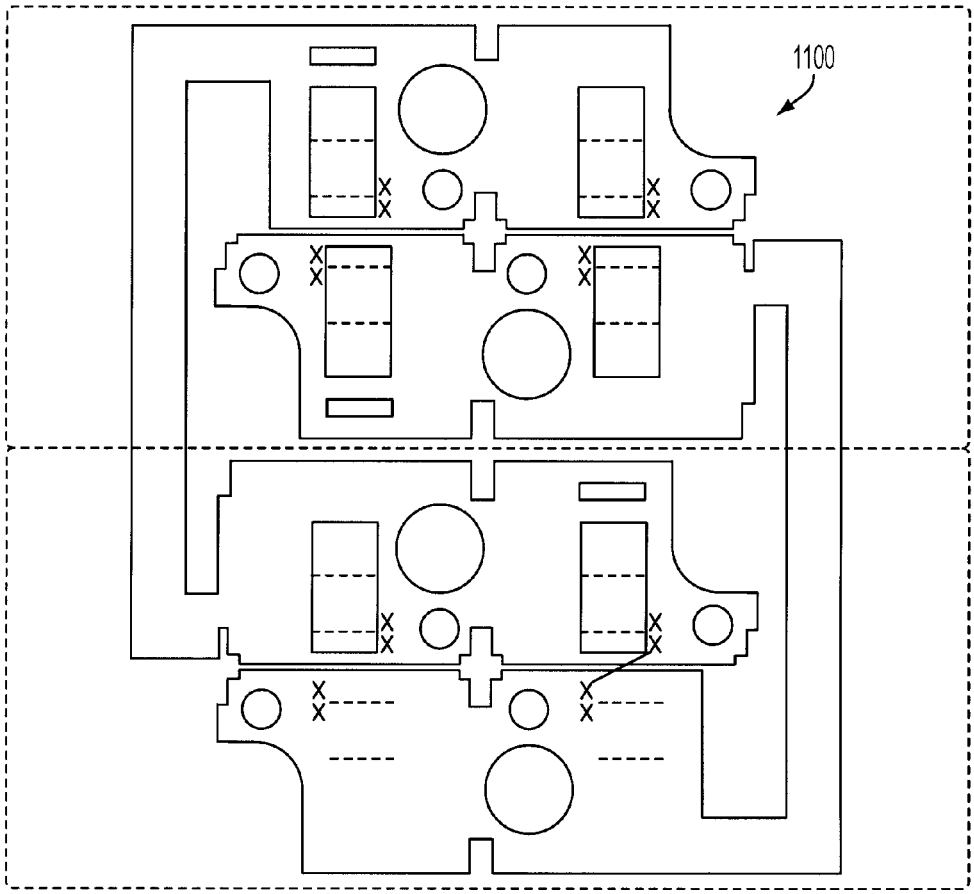
FIG. 11 is a top view of an exemplary bus bar configuration for making electrical connections in a connector assembly consistent with the present invention.

FIGS. 9A-9D and FIGS. 10A-10C illustrate first 900 and second 1000 exemplary housing members useful in forming a plug assembly consistent with the invention. The housing members may be separate pieces which may be compartmentalized, either by ribs or bosses, or nominally, for various functions including receiving and retaining a wire guide assembly consistent with the invention and associated electrical components and connections, as described for example in U.S. Pat. No. 6,206,720. FIG. 11 illustrates an exemplary electrical connection bus configuration 1100 established by a housing consistent with the invention for providing electrical connections to cable electrodes through IDC forks.

The housing members, the wire guide assembly portions, and other structural elements of the assembly or plug may be constructed from an insulated metal or ceramic, or from a polymer which has an impact strength of at least 5 foot-pounds when shaped into the particular element and measured by such tests as UL 746C. Selected polymers may be of light weight, can be shaped by injection or transfer-molding or similar processing techniques, and withstand required intermittent use and continuous use temperatures. Appropriate polymers include polycarbonate, nylon, polyester, polyphenylene sulfide, polyphenylene oxide, and other engineering plastics. Appropriate fillers and stabilizers may be present. To improve the impact strength of the assembly or plug, internal elements such as ribs and bosses and external elements such as grooves may be incorporated into the design of the various elements.

Although the invention has been described in detail for specific embodiments, it is to be understood that this is for clarity and convenience, and that the disclosure herein includes all the appropriate combinations of information found throughout the specification. It is to be understood that where a specific feature is disclosed in the context of a particular embodiment or figure, such feature can also be used, to the extent appropriate, in the context of another figure, in combination with another feature, or in the invention in general.

What is claimed is:

1. A wire guide assembly comprising:

a first wire guide portion having a first surface configured for defining a first portion of a cable opening; and a second wire guide portion disposed adjacent said first wire guide portion, said second wire guide portion having a second surface configured for defining a second portion of said cable opening;

at least one of said first and second wire guide portions being movable relative to the other of said portions for allowing expansion of said cable opening to allow said cable opening to receive electrical cables of different widths; and, at least one insulation displacement connector (IDC) coupled to said at least one of said first and second wire guide portions for making electrical connection to said electrical cables of different widths, said assembly comprising a first spring for biasing said first wire guide portion toward said second wire guide portion and a second spring for biasing said second wire guide portion toward said first wire guide portion.

2. A wire guide assembly comprising:

a first wire guide portion having a first surface configured for defining a first portion of a cable opening; and a second wire guide portion disposed adjacent said first wire guide portion, said second wire guide portion having a second surface configured for defining a second portion of said cable opening;

at least one of said first and second wire guide portions being movable relative to the other of said portions for allowing expansion of said cable opening to allow said cable opening to receive electrical cables of different widths; and, at least one insulation displacement connector (IDC) coupled to said at least one of said first and second wire guide portions for making electrical connection to said electrical cables of different widths; wherein a first insulation displacement connector (IDC) fork coupled to said first wire guide portion for making electrical connection to first electrodes of said electrical cables of different widths; and a second IDC fork coupled to said second wire guide portion for making electrical connection to second electrodes of said electrical cables of different widths; and a first spring for biasing said first wire guide portion toward said second wire guide portion and a second spring for biasing said second wire guide portion toward said first wire guide portion.

3. A wire guide assembly comprising:

a first wire guide portion having a first surface configured for defining a first portion of a cable opening; and a second wire guide portion disposed adjacent said first wire guide portion, said second wire guide portion having a second surface configured for defining a second portion of said cable opening;

at least one of said first and second wire guide portions being movable relative to the other of said portions for allowing expansion of said cable opening to allow said cable opening to receive electrical cables of different widths; and, at least one insulation displacement connector (IDC) coupled to said at least one of said first and second wire guide portions for making electrical connection to said electrical cables of different widths;

wherein each of said first and second wire guide portions comprises at least one projection extending from a surface thereof and configured to slidably mate with a corresponding feature in the other of said first and second wire guide portions.

4. A connector assembly comprising:

a housing;

a first wire guide portion disposed in said housing and having a first surface configured for defining a first portion of a cable opening; and a second wire guide portion disposed in said housing adjacent said first wire guide portion, said second wire guide portion having a second surface configured for defining a second portion of said cable opening;

at least one of said first and second wire guide portions being movable relative to the other of said portions for allowing expansion of said cable opening to allow said cable opening to receive electrical cables of different widths; and, at least one insulation displacement connector (IDC) coupled to said at least one of said first and second wire guide portions for making electrical connection to said electrical cables of different widths, wherein a first spring for biasing said first wire guide portion toward said second wire guide portion and a second spring for biasing said second wire guide portion toward said first wire guide portion.

5. A connector assembly comprising:

a housing;

a first wire guide portion disposed in said housing and having a first surface configured for defining a first portion of a cable opening; and a second wire guide portion disposed in said housing adjacent said first wire guide portion, said second wire guide portion having a second surface configured for defining a second portion of said cable opening;

at least one of said first and second wire guide portions being movable relative to the other of said portions for allowing expansion of said cable opening to allow said cable opening to receive electrical cables of different widths; and, at least one insulation displacement connector (IDC) coupled to said at least one of said first and second wire guide portions for making electrical connection to said electrical cables of different widths, wherein a first insulation displacement connector (IDC) fork coupled to said first wire guide portion for making electrical connection to first electrodes of said electrical cables of different widths; and a second IDC fork coupled to said second wire guide portion for making electrical connection to second electrodes of said electrical cables of different widths, and a first spring for biasing said first wire guide portion toward said second wire guide portion and a second spring for biasing said second wire guide portion toward said first wire guide portion.

6. A connector assembly comprising:

a housing;

a first wire guide portion disposed in said housing and having a first surface configured for defining a first portion of a cable opening; and a second wire guide portion disposed in said housing adjacent said first wire guide portion, said second wire guide portion having a second surface configured for defining a second portion of said cable opening;

at least one of said first and second wire guide portions being movable relative to the other of said portions for allowing expansion of said cable opening to allow said cable opening to receive electrical cables of different widths; and, at least one insulation displacement connector (IDC) coupled to said at least one of said first and second wire guide portions for making electrical connection to said electrical cables of different widths, wherein each of said first and second wire guide portions comprises at least one projection extending from a surface thereof and configured to slidably mate with a corresponding feature in the other of said first and second wire guide portions.

* * * * *